US006273781B1

(12) United States Patent
Yamasaki

(10) Patent No.: US 6,273,781 B1
(45) Date of Patent: Aug. 14, 2001

(54) TAMBOURINE PLAYING TOY FIGURE

(75) Inventor: Toshio Yamasaki, Long Beach, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/372,403

(22) Filed: Aug. 10, 1999

Related U.S. Application Data

(63) Continuation of application No. 08/914,729, filed on Aug. 19, 1997, now abandoned.

(51) Int. Cl.[7] ..... A63H 11/00

(52) U.S. Cl. ..... 446/330; 446/298; 446/375; 446/297

(58) Field of Search ..... 446/354, 405, 446/418, 336, 330, 312, 309, 308, 298, 297, 268, 408, 390, 376, 381, 352, 353; 84/402, 418

(56) References Cited

U.S. PATENT DOCUMENTS 3,477,171 * 11/1969 Bonanno ..... 446/185
4,212,132 * 7/1980 Lewanoni ..... 446/185
4,666,419 * 5/1987 Droller et al. ..... 446/330
5,334,069 * 8/1994 Lin ..... 446/268
5,394,766 * 3/1995 Johnson et al. ..... 446/330
5,587,545 * 12/1996 Nakada et al. ..... 446/298

* cited by examiner

*Primary Examiner*—Jacob K. Ackun, Jr.
*Assistant Examiner*—Urszula M. Cegielnik
(74) *Attorney, Agent, or Firm*—Roy A. Ekstrand

(57) ABSTRACT

A toy figure supports a pair of arm carriers pivotally secured within the torso interior near the shoulder of the toy figure. Each arm carrier includes an arm attachment apparatus and an inwardly extending arm shaft. A pair of pivot bearings pivotally support the arm shafts for pivotal motion in a horizontal plane. The arm shafts are carried within tight-fitting bores of the pivot bearings to facilitate rotational motion of the arm carriers and the supported arms about the shoulders in a vertical plane. A button is supported within the torso and extends outwardly through an aperture in the rear of the torso. The button is coupled to a pivotable yoke which is coupled to the interior ends of the arm shafts such that pivotal motion of the yoke causes pivotal motion of the arm shafts in a horizontal plane. A return spring urges the yoke and arm carriers toward the arms apart position of the figure and pressing the rear button pivots the arms forwardly to a hands together position which simulates a tambourine play.

11 Claims, 2 Drawing Sheets

TAMBOURINE PLAYING TOY FIGURE

CROSS-REFERENCE TO RELATED PATENT APPLICATION

This application is a continuation of a application entitled TAMBOURINE PLAYING TOY FIGURE filed Aug. 19, 1997 in the name of Toshio Yamasaki having Ser. No. 08/914,729 now abandoned.

1. FIELD OF THE INVENTION

This invention relates generally to toy figures and particularly to those providing arm motion simulating musical instrument play.

2. BACKGROUND OF THE INVENTION

Dolls which utilize articulated appendages such as those providing arm movements to simulate an activity are well known in the art and have been provided in a variety of forms. Such dolls have utilized manually operated mechanisms, spring driven mechanisms, and battery-powered motor mechanisms for moving the articulated arms. One of the more popular types of articulated dolls and toy figures is provided by dolls and toy figures which simulate musical instrument play. A substantial number of early doll designs utilized movable arms alone or together with movable legs to simulate musical instrument play and other similar motions. For example, U.S. Pat. No. 1,332,732 issued to Lizzi sets forth a DOLL with movable arms and a spring-driven power source. Similarly, U.S. Pat. No. 1,564,674 issued to Hodgkins sets forth an FIGURE TOY simulating the playing of a drum which illustrates early development of electrically powered dolls. Still further, U.S. Pat. No. 1,570,268 issued to Marx shows an early spring-powered design for a minstrel playing in a seated position. U.S. Pat. No. 1,800,775 issued to Bostwick sets forth a FIGURE TOY having movable arm and leg appendages controlled by a spring. Still further, U.S. Pat. No. 2,565,603 issued to Fraysur sets forth a DOLL having appendages, eyes, and eyelids moved by a spring power mechanism. Finally, another early example of movable dolls is found in U.S. Pat. No. 2,626,480 issued to Tipman which sets forth a PUPPET having over-center spring action controlling the appendages.

U.S. Pat. No. 3,672,096 issued to Johmann sets forth DOLLS driven by a battery-operated motor which through operative gears and leakage moves the doll appendages.

In more recent toy figure development, molded plastic dolls and toy figures have been provided with appendage movement. For example, U.S. Pat. No. 5,334,069 issued to Liu sets forth an ACTION CHARACTER FIGURE with sparking mechanism responsive to arm movement to emit sparks. U.S. Pat. No. 4,126,961 issued to Barlow, et al. sets forth an ARTICULATED DOLL having a torso and pivotally mounted head. A lever combination within the torso controls head pivoting motion. In a still further example of more recent toy figures having movable appendages, U.S. Pat. No. 4,006,555 issued to England, et al. sets forth a DOLL WITH INCREMENTALLY MOVABLE ARM having an actuator and a gear transmission system operatively connected to one of the doll's arms for imparting incremental motion to the arm. Finally, U.S.Pat. No. 3,978,611 issued to Strongin sets forth a TOY FIGURE WITH PISTOL DRAW ACTION having an articulated arm supporting a pistol in one hand. The pistol is withdrawn from the holster and extended to a firing position and a noise is emitted upon the operation of a lever.

U.S. Pat. No. 3,675,528 issued to Brick sets forth a TAMBOURINE having an unusual arrangement of pairs of jingles together with a hand grip molded into one inner side wall portion of the frame.

While the foregoing described prior art devices have to some extent improved the art and in some instances enjoyed commercial success, there remains nonetheless a continuing need in the art for evermore interesting, amusing and entertaining toy figures.

SUMMARY OF THE INVENTION

Accordingly, it is a general object of the present invention to provide an improved toy figure. It is a more particular object of the present invention to provide an improved toy figure which simulates the playing of a tambourine in a realistic fashion.

In accordance with the present invention, there is provided a toy figure comprising: a body having a torso defining a front, a rear, shoulders, head and neck; a pair of pivot bearings pivotally supported by the torso proximate the shoulders, each pivot bearing defining a bore therethrough; a pair of arm carriers each having cylindrical outer portions and inwardly extending arm shafts having inner ends, the arm shafts passing tightly through the bores; a pair of forwardly extending arms joined to the cylindrical portions each having a hand; a yoke pivotally supported within the torso having an upper portion coupled to the inner ends of arm shafts and a lower end; a slidable button supported by the torso and coupled to the lower end; and a return spring urging the yoke to pivot the upper portion forwardly, the button being pressed to pivot the upper end of the yoke rearwardly pivoting the arm carriers to bring the hands together.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
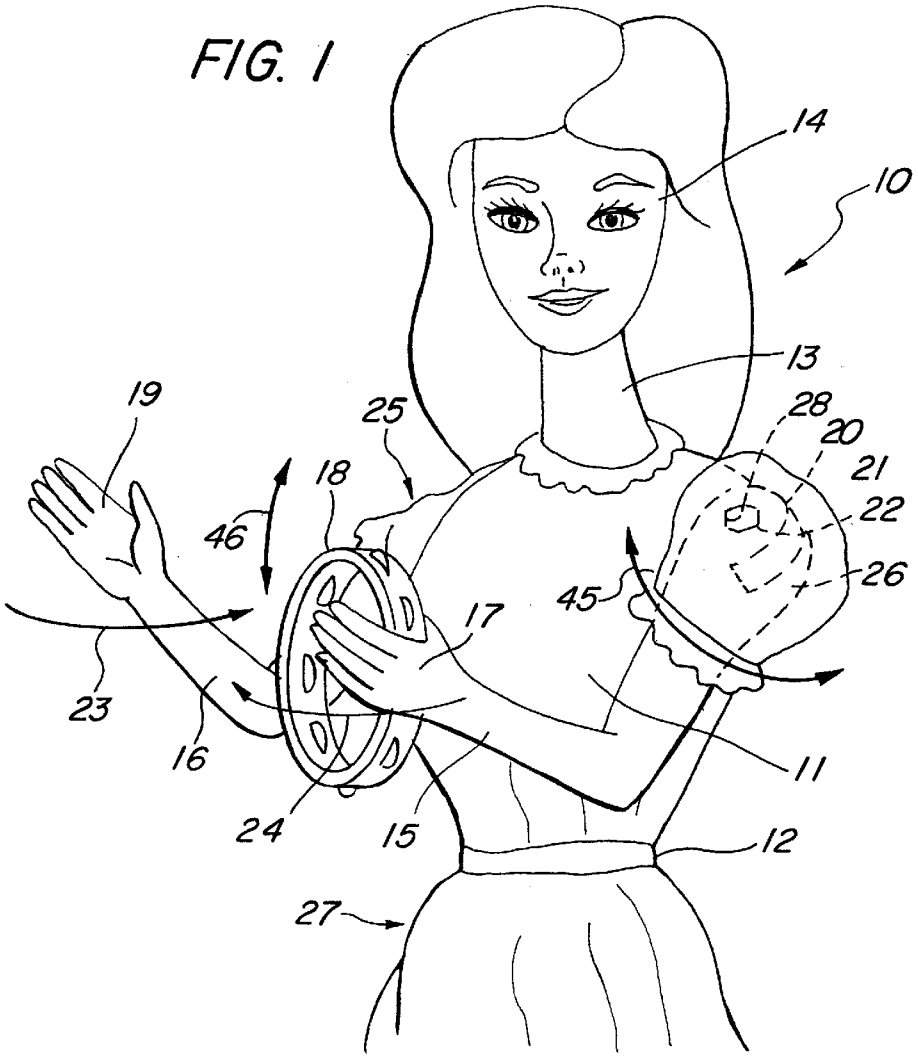
FIG. 1 sets forth a partial front view of a toy figure constructed in accordance with the present invention for playing a tambourine.

FIG. 1 sets forth a front view of a tambourine playing toy figure constructed in accordance with the present invention and generally referenced by numeral 10. Toy FIG. 10 is fabricated to resemble a young woman and thus includes a torso 11 supporting a neck 13 which in turn supports a head 14. Toy FIG. 10 further includes a pair of shoulders 20 and 25 formed on torso 11 supporting a corresponding pair of arms 15 and 16. The shoulder structure for toy FIG. 10 is set forth below in greater detail. However, suffice it to note here that each of arms 15 and 16 terminates in a slotted end such as slotted end 26 formed in the upper portion of arm 15. While not seen in FIG. 1, it will be understood that arm 16 terminates in a similar slotted end. Shoulder 20 is further formed by an arm carrier 22 extending outwardly from torso 11 and supported in the manner set forth below in FIGS. 2, 3 and 4. Arm carrier 22 is received within slotted end 26 and secured with a hexagonal pin 21. With arm 16 secured at shoulder 25 in a similar attachment, toy FIG. 10 is able in accordance with the structure set forth below in greater detail to move arms 15 and 16 in vertically pivoting motion about shoulders 20 and 25 as indicated by arrows 45 and 46 respectively. Thus, arms 15 and 16 of toy FIG. 10 may be raised from the intermediate position shown in FIG. 1 or lowered to a lower position while maintaining the separation between hands 17 and 19.

In operation and in accordance with the present invention, toy FIG. 10 may be posed in the height at which arms 15 and 16 support hands 17 and 19 together with tambourine 18. In further accordance with the present invention and as is set forth below in greater detail, regardless of the height to which arms 15 and 16 are "posed", the tambourine playing action of toy FIG. 10 may be carried forward by simply pressing and releasing a push button 30 extending from the rear of torso 11 (push button 30 seen in FIG. 2). Thus, as the user pushes push button 30 (seen in FIG. 2) inwardly of torso 11, arms 15 and 16 pivot inwardly about shoulders 20 and 25 in the manner seen in FIG. 4 below to bring hand 19 and hand 17 bearing tambourine 18 closer together to simulate an impact of hand 19 against tambourine 18. When the push button is released, by means also set forth below in greater detail, a return spring operates to pivot arms 15 and 16 outwardly in the opposite directions of arrows 24 and 23 returning toy FIG. 10 to the position of FIG. 1. As push button 30 (seen in FIG. 2) is repeatedly pushed and released, toy FIG. 10 appears to play tambourine 18.

In the preferred fabrication of the present invention, tambourine 18 is received within hand 17 in a snap-fit attachment. However, other forms of attaching tambourine 18 to hand 17 may be undertaken without departing from the spirit and scope the present invention. Also, in its preferred form, tambourine 18 is a miniature tambourine having musical jingles and capable of producing sound. However, a simulated non-sound producing tambourine may be utilized without departing from the spirit and scope of the present invention. The remainder of toy FIG. 10 such as neck 13, head 14 and lower body 27 may be fabricated entirely in accordance with conventional fabrication techniques.

Figure 2:
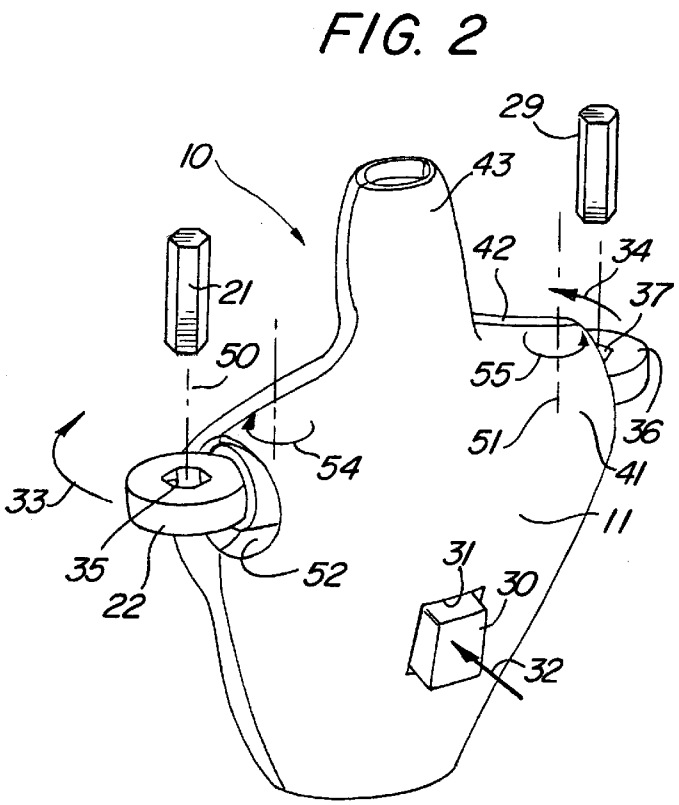
FIG. 2 sets forth a rear perspective view of the upper torso and arm linkage apparatus of the present invention toy figure.

FIG. 2 sets forth a rear perspective view of torso 11 having the outer garment of toy FIG. 10 removed and having head 14 and lower body 27 removed. In addition, FIG. 2 shows toy FIG. 10 having arms 15 and 16 removed from arm carriers 22 and 36 respectively. Torso 11 of toy FIG. 10 is preferably formed of a pair of molded plastic half portions referenced as rear half 41 and front half 42 which are joined to form torso 11 and attached using conventional fabrication techniques such as conventional fasteners, adhesives or welding. The combination of rear half 41 and front half 42 of torso 11 when combined defines a pair of shoulder apertures 52 and 53 (the latter seen in FIG. 3) together with a rear aperture 31. By means set forth below in FIGS. 3 and 4, a depressible push button actuator 30 is movably supported within torso 11 and extends outwardly through aperture 31. By means also set forth below in greater detail, arm carriers 22 and 36 are pivotally supported about respective axes of rotation 50 and 51 and in response to movement of push button 30 by means set forth below pivotally move in the manner indicated by arrows 54 and 55.

In operation, push button 30 is spring-biased by spring 65 (seen in FIG. 3) to the extending position shown in FIG. 2. Correspondingly, the force of spring 65 also pivots arm carriers 22 and 36 to their rearmost position shown in FIG. 2. In accordance with the present invention, as the user presses push button 30 inwardly in the direction indicated by arrow 32, arm carriers 22 and 36 pivot about axes 50 and 51 respectively in the directions indicated by arrows 33 and 34. Thus, as push button 30 is pushed inwardly, arms 15 and 16 (seen in FIG. 1) are pivoted inwardly and mutually toward each other as arm carriers 22 and 36 pivot in the directions of arrows 33 and 34 respectively. To assure the proper inward motion of arms 15 and 16 (seen in FIG. 1) in response to pressing of push button 30, arm carriers 22 and 36 define respective hexagonally-shaped apertures 35 and 37. With temporary return to FIG. 1, it will be noted that slotted end 26 of arm 15 is received upon arm carrier 22. It will be further noted that slotted end 26 of arm 15 defines a hexagonally-shaped aperture 28 which receives a hexagonally-shaped pin 21.

Returning to FIG. 2, hexagonal pin 21 is shown assembled into hexagonal aperture 35 of arm carrier 22. Similarly, hexagonal pin 29 is assembled into hexagonal aperture 37 of arm carrier 36. Thus, each arm is securely maintained in a fixed position upon arm carriers 22 and 36 and is rotatable in response to push button 30 to and from the inward directions of rotation shown as arrows 33 and 34 bringing hand 19 against tambourine 17 (seen in FIG. 1).

Figure 3:
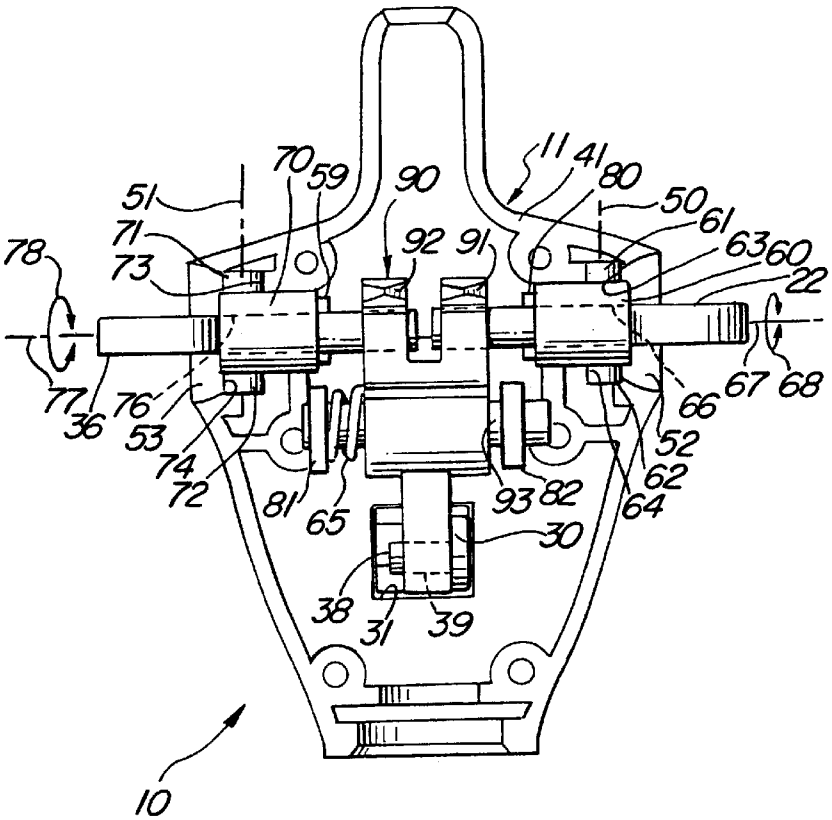
FIG. 3 sets forth a partial assembly view of the operative mechanism of the present invention having the front torso portion removed.

FIG. 3 sets forth a front view of doll 10 having front torso half 42 (seen in FIG. 2) removed to expose the operative mechanism supporting and moving arms 15 and 16 in the manner described above in FIG. 1. Thus, toy FIG. 10 includes a torso 11 having a rear torso half 41 defining an aperture 31 in the lower back portion thereof and a pair of shoulder apertures 52 and 53. It will be apparent to those skilled in the art by returning briefly to FIG. 2 that in fact shoulder apertures 52 and 53 are formed between each half of torso 11. Toy FIG. 10 includes a pivot bearing 70 having a bore 76 extending therethrough and defining a pair of pivot posts 71 and 72. Posts 71 and 72 are received within recesses 73 and 74 formed in rear torso half 41. Posts 71 and 72 permit pivot bearing 70 to be pivotable about axis 51 in the manner shown in FIG. 2. Arm carrier 36 includes an inwardly extending arm shaft 79 which passes through bore 76 of pivot bearing 70 in a snug interference fit which provides a frictional attachment.

A second pivot bearing 60 identical to pivot bearing 70 defines a bore 66 therethrough and a pair of posts 61 and 62 received within recesses 63 and 64 of torso half 41 to provide support of pivot bearing 60 allowing bearing 60 to be pivotable about axis 50. Arm carrier 22 includes an inwardly extending arm shaft 69 passing through bore 66 in a snug-fit which frictionally maintains the angular or rotational position of arm carrier 22 within pivot bearing 60.

Thus, the support of arm carriers 22 and 36 within pivot bearings 60 and 70 allows arm carriers 22 and 36 to be pivotable about vertical axes 50 and 51 providing the above-described tambourine playing inward and outward motion of arms 15 and 16. In addition, the interference fit of arm shaft 69 and 79 of arm carriers 22 and 36 facilitates the possibility of arms 15 and 16 in the manner shown in FIG. 1 as indicated by arrows 45 and 46 therein. In FIG. 3, this posable arm motion axis is shown as rotational axes 67 and 77 with the rotation facilitating posing of arms 15 and 16 indicated by arrows 68 and 78.

Toy FIG. 10 further includes a yoke 90 having a castellated upper portion having gaps 91 and 92 formed therein. In accordance with the present invention, the interior ends of arm shafts 69 and 79 extend into gaps 91 and 92. Yoke 90 is pivotally supported by a pivot shaft 93 shown supported within a pair of retainers 81 and 82 formed within torso half 41. In the preferred fabrication of the present invention, retainers 81 and 82 are formed between mating semicircular portions of the torso halves as torso 11 is formed by bringing torso half 42 into alignment and attachment with torso half 41. A spring 65 (better seen in FIG. 4) provides a spring force operative upon yoke 90 urging yoke 90 toward the arms retracted position shown in Figure Yoke 90 further defines an aperture 39 which receives pin 38 of push button 30. As described above, push button 30 extends through aperture 31 formed in torso half 41. A pair of retainer pins 80 and 59 maintain arm shafts 69 and 79 within pivot bearings 60 and 70 respectively.

Figure 4:
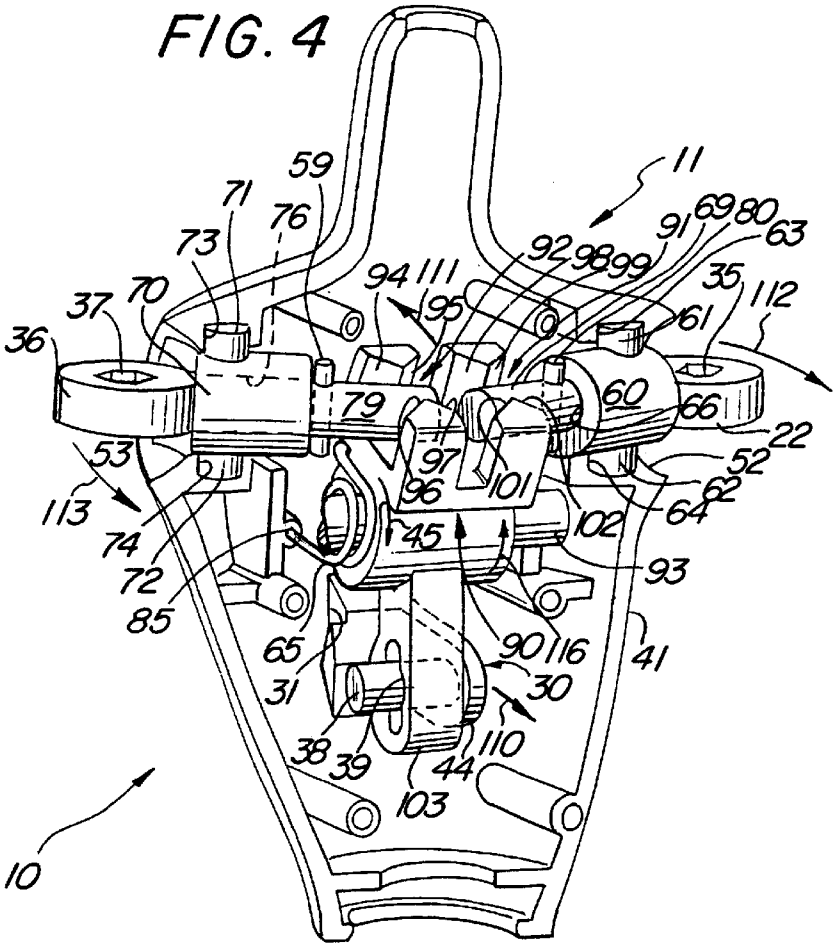
FIG. 4 sets forth a perspective partial assembly view of the present invention doll having the front torso body portion removed.

FIG. 4 sets forth a perspective view of the arm motion mechanism of the present invention toy figure positioned within rear torso half 41 and having front torso half 42 (seen in FIG. 1) removed. Doll 10 includes a torso 11 having a rear torso half 41 defining a pair of opposed recesses 63 and 64 at one shoulder and recesses 73 and 74 at the opposite shoulder. Torso half 41 further defines shoulder apertures 52 and 53 and a rear aperture 31. A pivot bearing 60 is supported within recesses 63 and 64 by cylindrical posts 61 and 62. Pivot bearing 60 further defines a bore 66 extending therethrough. Arm carrier 22 defines a hexagonal aperture 35 and an inwardly extending arm shaft 69. Arm shaft 69 extends through bore 66 and is secured by a transverse pin 80.

Pivot bearing 70 defines cylindrical posts 71 and 72 supported within recesses 73 and 74 of half torso 41. Pivot bearing 70 further defines a bore 76 extending therethrough. An arm carrier 36 defines a hexagonal aperture 37 and an inwardly extending arm shaft 79. Shaft 79 passes through bore 76 and is secured by a transverse pin 59. A yoke 90 defines a supporting shaft 93 which, as is better seen in FIG. 3, is supported in a pivotal attachment by a pair of retainers 81 and 82. For purposes of illustration, retainers 81 and 82 are omitted from FIG. 4. Yoke 90 further includes a castellated upper portion defining a pair of gaps 91 and 92. Gaps 91 and 92 receive the interior ends of arm shafts 69 and 79 respectively. To facilitate pivotal motion of arm shafts 69 and 79 within gaps 91 and 92, angled facets are formed on the castellated members of yoke 90. Thus, yoke 90 defines angled facets 94, 95, 96 and 97 on each side of arm shaft 79 and further defines angled facets 98, 99, 101 and 102 on each side of arm shaft 69. A return spring 65 encircles shaft 93 and is secured at one end within an aperture 85 of torso half 41. The remaining end of spring 65 fits beneath a nearby edge of the castellated portion of yoke 90. Spring 65 provides a spring torque urging yoke 90 toward rotation about shaft 93 in the direction indicated by arrow 115. Yoke 90 further defines a downwardly extending tab 103 having an aperture 39 formed therein. Push button 30 is slidably received within aperture 31 and includes a forwardly extending tab 44. A pin 38 extends from tab 44 and is received within aperture 39 of tab 103.

In operation, in the absence of pressure upon button 30, spring 65 rotates yoke 90 about shaft 93 in the direction indicated by arrow 115. The rotational position of yoke 90 thus produced pivots the interior ends of arm shafts 69 and 79 forwardly to the position shown in FIG. 4. Correspondingly, as arm carriers 22 and 36 pivot about the posts of pivot bearings 60 and 70, the outer portions of arm carriers 22 and 36 are pivoted to the rear. This position shown in FIG. 4 defines the normal or relaxed position of the present invention toy figure and corresponds to the "hands apart" position shown in FIG. 1. In this position, the user is able to rotate arms 15 and 16 (seen in FIG. 1) in the directions up or down indicated by arrows 45 and 46 due to the ability of arm carriers 22 and 36 and particularly arm shaft 69 and 79 to rotate within their respective bores of pivot bearings 60 and 70. Thus, the toy figure is posable and the arms may be moved to a position in front of the face or above or lowered to a position near the waist.

Tambourine playing motion regardless of the posed position it of the toy figure's arms is attained by the user pressing push button 30 inwardly in the direction indicated by arrow 110. As push button 30 is forced inwardly overcoming the force of spring 65, tab 103 of yoke 90 is carried inwardly rotating yoke 90 about shaft 93 in the direction indicated by arrow 116. As yoke 90 rotates, the castellated portion of yoke 90 is moved rearwardly in the direction indicated by arrow 111. As the upper portion of yoke 90 pivots inwardly, arm shafts 69 and 79 are pivoted about posts 61 and 62 and posts 71 and 72 respectively to pivot the arm attachment portions of arm carriers 22 and 36 forwardly in the directions indicated by arrows 112 and 113. With temporary reference to FIG. 1, this inward pivotal motion pivots arms 1 and 16 inwardly as indicated by arrows 24 and 23 simulating a tambourine strike. The user then releases button 30 and the force of spring 65 returns the arm moving mechanism to the position shown in FIG. 4. Periodic or rhythmic pressing and releasing of push button 30 produces corresponding arm motions simulating tambourine play.

What has been shown is a novel toy figure which provides amusing and entertaining arm motions similar to the playing of a tambourine as the hands are brought together to strike the tambourine against the other hand. In the preferred fabrication of the invention, the tambourine is removable from its supported hand allowing the figure to function in the same arm and hand motion which now, in the absence of a tambourine, simulates clapping. Thus, the present invention doll shown above is able to simulate the actions of tambourine playing or if the tambourine is made removable, simulate actions of hand clapping.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a body having a torso defining a front, a rear, shoulders, head and neck;

a pair of pivot bearings pivotally supported for front-to-rear pivotal movement relative to said torso by said torso proximate said shoulders, each pivot bearing defining a bore therethrough;

a pair of arm carriers each having cylindrical outer portions and inwardly extending arm shafts having inner ends, said arm shafts passing tightly through said bores;

a pair of forwardly extending arms joined to said cylindrical portions each having a hand;

a yoke pivotally supported within said torso having an upper portion coupled to said inner ends of said arm shafts and a lower end;

a slidable button supported by said torso and coupled to said lower end; and a return spring urging said yoke to pivot said upper portion forwardly, said button being pressed to pivot said upper end of said yoke rearwardly pivoting said arm carriers to bring said hands together, said inwardly extending shafts and said pivot bearing bores cooperating to allow said pair of arms to be posed at raised or lowered or forwardly extending positions independent of movement of said hands apart or together.

2. A toy figure comprising:

a doll body defining a torso having a front portion and a rear portion, said rear portion defining a button aperture and said body defining shoulder apertures;

a pair of arm carriers each having an arm shaft and a generally cylindrical portion;

a pair of pivot bearings each having a bore receiving one of said arm shafts and each pivotally supported by said torso near said shoulder apertures such that said generally cylindrical portions are supported outside said shoulder apertures;

a pair of arms secured to said generally cylindrical portions and extending forwardly, each arm supporting a hand;

a yoke pivotally supported in said torso and having an upper coupler coupled to said arm shafts and a lower end; and a button slidably movable in said button aperture extending into said torso and being coupled to said lower end of said yoke, p1 said arm carriers being pivotably within said pivot bearings to pose the position of said arms between raised, lowered or forwardly extending positions and said pivot bearings pivoting in a horizontal plane when said button is pushed and released causing said yoke to pivot and move said arm shafts forward and back to bring said hands together and apart and said pose of said arm position being independent of.

3. The toy figure of claim 2 wherein said yoke includes a return spring urging said upper coupler of said yoke rearwardly.

4. The toy figure of claim 3 wherein said arm shafts define interior ends and wherein said upper coupler defines a pair of gaps receiving said interior ends.

5. The toy figure of claim 4 wherein said upper coupler is castellated.

6. The toy figure of claim 5 wherein said arms each define respective slots which receive said generally cylindrical portions of said arm carriers.

7. The toy figure of claim 2 wherein one of said hands includes a miniature tambourine.

8. The toy figure of claim 7 wherein said yoke includes a return spring urging said upper coupler of said yoke rearwardly.

9. The toy figure of claim 8 wherein said arm shafts define interior ends and wherein said upper coupler defines a pair of gaps receiving said interior ends.

10. The toy figure of claim 9 wherein said upper coupler is castellated.

11. The toy figure of claim 10 wherein said arms each define respective slots which receive said generally cylindrical portions of said arm carriers.

* * * * *